US006499262B1

(12) United States Patent
Pinchot et al.

(10) Patent No.: US 6,499,262 B1
(45) Date of Patent: Dec. 31, 2002

(54) CEILING PANEL

(75) Inventors: Mark A. Pinchot, Solon, OH (US); Curtis P. Taylor, Chagrin Falls, OH (US)

(73) Assignee: Frank Novak & Sons, Inc., Cleveland, OH (US)

( * ) Notice: Subject to any disclaimer, the term of this patent is extended or adjusted under 35 U.S.C. 154(b) by 0 days.

(21) Appl. No.: 09/659,268

(22) Filed: Sep. 11, 2000

(51) Int. Cl.[7] ..... E04B 1/348

(52) U.S. Cl. ..... 52/273; 52/222; 52/145; 52/288.1; 160/327; 160/368.1; 403/373

(58) Field of Search ..... 52/222, 273, 288.1, 52/476, 716.3, 716.4, 716.8, 717.01, 144, 145; 160/327, 371, 392, 395, 368.1; 403/373, 374, 338

(56) References Cited

U.S. PATENT DOCUMENTS

| | | | | |
|---|---|---|---|---|
| 2,302,547 A | | 11/1942 | Hasenburger et al. | |
| 3,783,931 A | | 1/1974 | Assael | |
| 3,866,016 A | | 2/1975 | Tombu | |
| 4,018,260 A | | 4/1977 | Baslow | |
| 4,026,081 A | | 5/1977 | Delaney et al. | |
| 4,058,946 A | | 11/1977 | Habrant | |
| 4,625,490 A | | 12/1986 | Baslow | |
| 4,782,883 A | | 11/1988 | Braiotta | |
| 4,817,699 A | | 4/1989 | Fein | |
| 4,825,931 A | | 5/1989 | Fein | |
| 4,907,637 A | | 3/1990 | Hintsa | |
| 4,986,332 A | | 1/1991 | Lanuza | |
| 5,115,616 A | * | 5/1992 | Nixon | 52/144 |
| 5,117,598 A | | 6/1992 | Livingston et al. | |
| 5,134,822 A | | 8/1992 | Edlin | |
| 5,214,891 A | | 6/1993 | Edlin | |
| 5,214,892 A | | 6/1993 | Livingston et al. | |
| 5,339,587 A | | 8/1994 | Ruhlmann | |
| 5,501,047 A | | 3/1996 | Delaunay et al. | |
| 5,970,669 A | * | 10/1999 | Livingston | 52/222 |
| 6,164,364 A | * | 12/2000 | Morris | 160/327 |

OTHER PUBLICATIONS

Unique Concepts, Inc., "Fabric as an Architectural Finish. The Solution . . . FABRI TRAK® Upholstered Wall System", Custom is Standard, 09500/FAB, BuyLine 2868, 1996, pp. 1–12.

* cited by examiner

*Primary Examiner*—Yvonne M. Horten
(74) *Attorney, Agent, or Firm*—Pearne & Gordon LLP

(57) ABSTRACT

An acoustical panel assembly for a suspended ceiling comprising a rigid frame, sound absorbing material, sound transmission attenuation material and a face fabric. The frame is an assembly of extruded members secured together in a polygonal pattern such as a square or a rectangle. The fabric is secured to the frame by gripping elements integral with the frame. Marginal portions of the fabric are captured and hidden in receiving chambers formed by the frame members.

18 Claims, 3 Drawing Sheets

CEILING PANEL

BACKGROUND OF THE INVENTION

The invention relates to improvements in suspended ceiling panels and, more specifically, to fabric covered panels for suspended ceilings.

PRIOR ART

Suspended grid ceiling systems are in widespread use because of their functionality in allowing access to the plenum for service, alternation and/or addition to wiring, air conditioning, heating, plumbing and other hardware typically found in a building. Ceiling panels that lay in the suspended grid come in a variety of materials and finishes. Most commonly, the panels are rigid boards made of various materials that often have their visible faces perforated or otherwise textured to obtain a level of sound absorption. U.S. Pat. No. 4,026,081 shows an example of a fabric covered acoustical panel with a rigid perimeter frame for use with a suspension ceiling grid. The product disclosed in this patent requires a vinyl rope to retain the fabric and the attendant complications of handling and installing the rope. Additionally, this patented product may be difficult to install and especially to remove. This is of particular consequence where the person attempting to install or remove the panel is unfamiliar with the motions which apparently must be performed to place or remove the patented panel.

SUMMARY OF THE INVENTION

The invention provides an improved fabric covered acoustical panel assembly for suspended ceiling structures that uses inexpensive parts, is readily assembled and is easy to install and remove. The disclosed panel assembly has a rigid polygonal perimeter frame that serves to hold the fabric, a sound absorbing material and a sound transmission attenuating material in assembled relation and precisely engages supporting flanges of the tees of a suspension grid. The frame is preferably an extrusion of suitable thermoplastic such as polyvinylchloride.

As disclosed, the frame has integral gripping elements that frictionally engage the margin of the fabric facing. The gripping elements allow the fabric to be simply and quickly installed on the frame by tucking its margins into the reach of the gripping elements. The frame includes a cavity for receiving any excess marginal material and thereby neatly controlling its location regardless of limited extra material or imperfect positioning of the fabric. Thus, the edge of the fabric does not "read through" the visible part of the fabric. The gripping elements of the frame are situated so that the fabric margins can be tucked into their control from operations conducted on the front or visible face of the panel so that the fabric condition and position can be continuously observed and corrected for proper positioning by the person installing the fabric on the frame. Additionally, the frame includes retaining rib elements for holding the sound absorbing material in place. Still further, the frame includes a support area for receiving and locating the sound transmission attenuating material.

The disclosed panel construction is suitable for factory mass production, limited production in a small shop or custom manufacture at the site where the panels are to be installed. The frame is assembled by connecting its sides together at corners with an angle bracket that is simply pushed longitudinally into the sides and is retained in place by a strong friction fit. The panel assembly can be readily recovered with fabric when damaged, outdated, or other conditions require a change.

DESCRIPTION OF THE PREFERRED EMBODIMENTS

Figure 1:
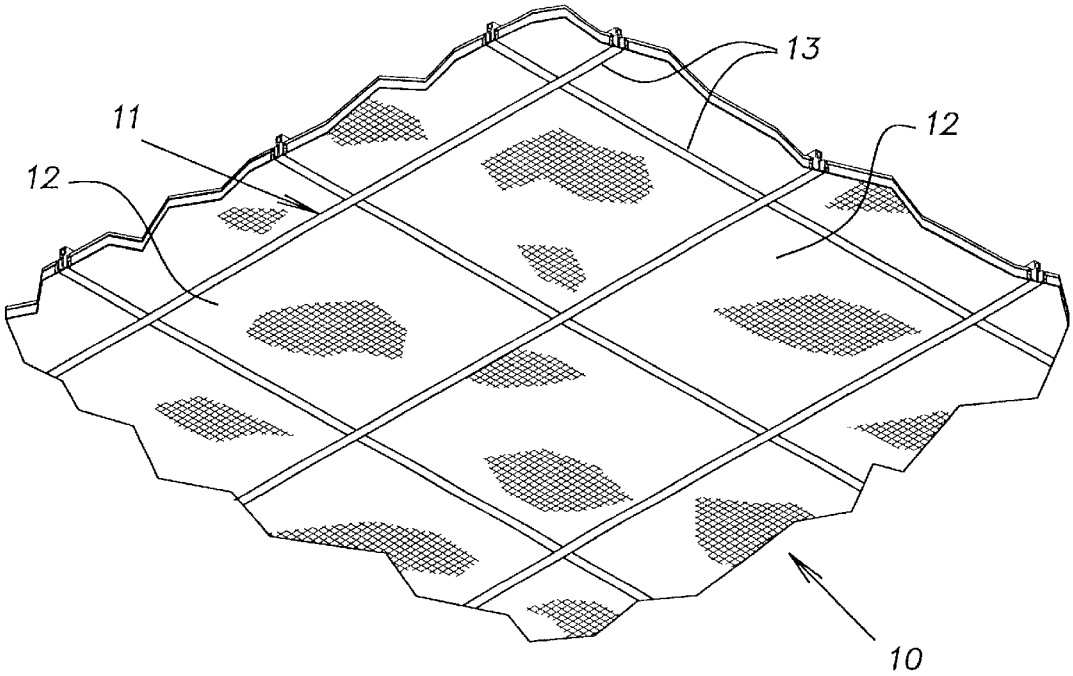
FIG. 1 is a fragmentary perspective view of a suspended ceiling incorporating ceiling panels constructed in accordance with the invention.

Referring now to the drawings and in particular to FIG. 1, there is illustrated a suspended ceiling structure 10 comprising a rectangular grid 11, and a plurality of panels 12 supported on the grid. The grid 11, according to conventional practice, is made of runners 13 having the configuration of an inverted tee. The runners 13 are typically suspended from an overhead structure with wires that are looped through holes in a stem or vertical part 14 of the grid runner 13. The runners 13 are made of steel but can be of other suitable material. The runners 13 have oppositely extending horizontal flanges 16 that serve to support the panels 12 in a manner to be described. Commonly, the tees or runners 13 are provided with connections at their ends to enable them to be joined with intersecting tees and/or with ends of other tees. Typically, the tees are arranged in a rectangular array that has openings for the panels 12 that nominally measure 2'×2' or 2'×4'.

The panels 12 are assemblies of a rigid perimeter frame 17, fabric or fabric sheet 18, sound absorbing material 19 and sound transmission attenuating material 20. The fabric sheet 18 forms the visible face or face side of the panel when it is installed in the ceiling grid. The illustrated frame 17 is an assembly of four side members 22 and four corner connectors 56. The four side members have identical or substantially similar cross-sections shown as typical in FIG. 2. The side members 22 are preferably formed as extrusions of a suitable thermoplastic material such as polyvinylchloride with flame resistant properties satisfying suitable standards such as ASTM-E84 and are Class A-rated for flame spread. The cross-section of a side member 22, which is uniform along its length, is somewhat complex to enable it to serve multiple functions. The cross-section includes a lower generally horizontally extending flange 26 which has an extension or flange 35 having an upwardly curved or angled lower surface 24 which prevents the plastic frame member "reading through" the stretched fabric 18. Extending generally vertically upwardly from the flange 26 is a web 27 having a plurality of barbs 28 projecting towards the center of the panel 12. The barbs 28 are optional and have angled surfaces 29 on their upper faces and less inclined almost horizontal surfaces 30 on their lower sides. A main bridge or flange 31 at the top of the web 27 extends primarily outwardly away from the center of the panel 12. Towards the center of the panel 12, the bridge 31 provides a projection 32 that has a steeply inclined camming surface 33 and a generally horizontal retaining face 34.

A pair of spaced parallel flanges 36 extend vertically from the main bridge 31. Oppositely facing ribs 37 existing on each flange 36 have lower surfaces 38 that cooperate with surfaces 39 of the flanges 36 to form the sides of a longitudinally extending rectangular channel 41 of a C section. Depending from the main bridge or flange 31 and lying in the same plane as the upstanding flange 36 is a generally vertical web 42. A generally horizontal flange 43 projects from a lower end of the web 42 in a direction away from the center of the panel 12. As shown, a lower surface 44 of the flange 43 is inclined upwardly in a direction away from the center of the panel 12 to bias the vertical web 42 towards the center of the panel 12 when the weight of the panel is borne by this surface on the flange 16. Alternatively the lower surface 44 may be horizontal. Adjacent its lower end, the web 42 has a series of longitudinally extending small gripping ribs 45 on a surface 46 facing the center of the panel 12. A generally vertical leg 47 extends upwardly from an outer edge of the flange 26. The flange 26 and leg 47 intersect to form a rounded corner 48. The leg 47 has an inwardly bent area 49 that provides a longitudinally extending recess 51 that is roughly centered, in a vertical sense, on a plane tangent to the inner end of the flange surface 44. Adjacent its upper edge, the leg 47 has a series of small gripping ribs 52 that oppose the ribs 45 on the depending web 42. Ideally, in a free state and before assembly of the fabric 18 as described below, the leg 47 is configured so that its ribs 52 resiliently contact the ribs 45 of the depending web 42. The depending web 42, main flange 31, barbed web 27, lower flange 26 and leg 47 cooperate to form a closed chamber 54.

Figure 3:
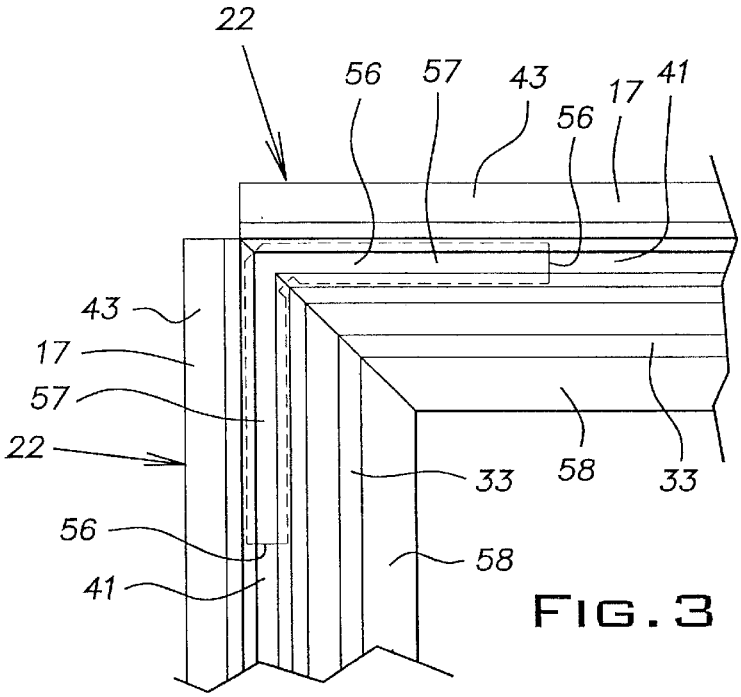
FIG. 3 is a fragmentary plan view of the corner of a perimeter frame of the panel according to the first embodiment.

The side members 22 are mitered at the corners of the frame 17 as shown in FIG. 3. The members 22 are joined at the corners by a corner connector or right angle piece or angle bracket 56. The bracket 56 can be made of suitable plastic material such as polyvinylchloride. The bracket 56 is economically made by cutting short sections of a long piece of angle stock. A leg 57 of each angle bracket 56 is assembled in the channel 41 of the two frame side members 22 forming a corner. The cross-section of the bracket legs 57 is preferably proportioned to provide a tight force fit into the channel 41 to frictionally lock the members 22 together and thereby assure that the frame can be freely handled without the risk of it inadvertently coming apart.

The distance between an upper face 58 of the lower flange 26 and an underside 34 of the projection 32 is made to receive the thickness of the sound absorbing material 19. Preferably the sound absorbing material is commercially available rigid fiberglass board of 1" thickness and a density of preferably 6 lbs. per cubic foot and less preferably as low as 3 lbs. and as high as 20 lbs. density. The planar dimensions of the sound absorbing material or board are made to closely fit within the perimeter frame 17 so as to have its edges gripped and held in position by the barbs 28. The camming surface 33 facilitates inserting the sound absorbing material into the frame 17.

A top face 61 of the main flange 31 and an inner face 62 of the inner flange 36 form a perimeter pocket area for reception of the sound transmission attenuating material 20. This material is preferably gypsum board or drywall but can be other suitable fire resistant materials such as sheet rock, plywood, flake board, particle board or the like, rated to meet fire code requirements for combustibility and smoke and flame spread. The material 20 is cut to a planar size to loosely fit within and be contained by the boundary formed by the flange surface 62. The board can have a thickness of, for example, ⅜".

With the frame 17 assembled and the sound absorbing board material 19 in the frame, the frame can be inverted onto a suitable support such as a work table for installation of the face material or fabric 18. The fabric is a suitable material such as a quality weight upholstery fabric that, ideally, is hydrophobic or with as little hydrophilicity as possible so as to avoid moisture absorption and potential sagging. Preferred fabric materials are panel fabrics, such as panel fabrics from Guilford of Maine. Suitable fabric materials include polyester as a preferred material and, less preferably, polyolefin materials, vinyl-coated fabric, or acrylic fabric. The fabric 18, like the other materials of the panel, are flame retardant and preferably satisfy ASTM standard E84. The fabric 18 is cut oversize of the finished fabric covered area. Marginal areas of the fabric are tucked in the crevice between the web 42 and leg 47 with a flat tool like a putty knife. This can be done most efficiently by working the fabric material into the crevice at one side member 22 first and then into the crevice at the opposite side. This procedure is then performed at the remaining two sides. The cavity or chamber 54 is relatively large so it readily accommodates excess marginal material of the fabric 18. Proper positioning and tensioning of the fabric 18 is relatively easy because its alignment and local stretch can be viewed as it is being tucked into the frame crevices. The fabric 18 is stretched over the frame to the desired degree by appropriate manipulation of the flat installation tool. The fabric 18 is reliably held in place by the gripping ribs 45, 52 to a degree sufficient to maintain the fabric tensioned during normal surface life of the fabric 18. Other gripping elements known in the art may be used, such as opposing teeth or projections or interlocking surfaces or other surfaces which lockingly or frictionally hold the fabric. Any loosening of the fabric after a panel 12 has been installed can be accomplished in the same manner as the fabric was originally tensioned. It is also noteworthy that the ribs 45, 52 will release the fabric when a strong pulling force is applied such as in the case where it is desired to replace the fabric.

After the fabric has been installed, the subassembly of the frame 17, fabric 18 and sound absorbing material 19 can be turned so that the fabric is facing downward and the sound transmission attenuating material 20 can be positioned on the frame.

With placement of the sound transmission attenuating board material 20 in the pocket bounded by the flanges 36, the assembly of the panel 12 is complete. The panel is installed on the grid 11 in a generally conventional lay-in manner. The hollow area of the recess 51 can receive a portion of the grid tee flange 16 to permit the panels 12 to be installed on a grid even where the grid is slightly out of proper position or where the panel is slightly oversize for the opening left by the grid. It will be understood that the panel assembly 12 can be manufactured in a factory, small shop, or on site where it is to be used. The frame members 22 are saw cut from long stock lengths. The disclosed panel assembly 12 does not require any fasteners or adhesives apart from the right angle bracket 56. If desired, the area adjacent the corner 48 can be covered with double-sided tape or otherwise provided with pressure-sensitive adhesive to facilitate placement and stretching of the fabric 18 on the frame 17.

Figure 2:
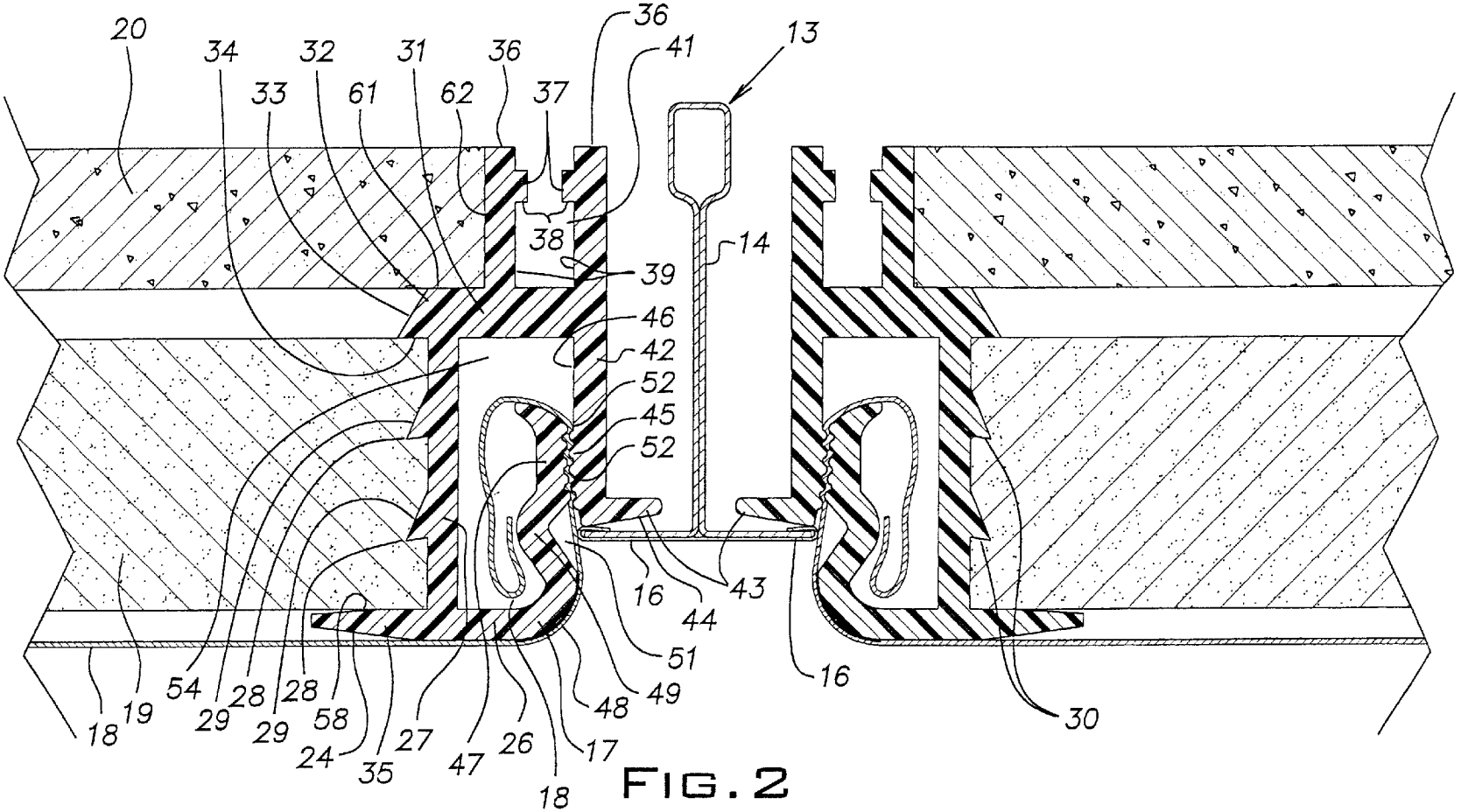
FIG. 2 is a fragmentary cross-sectional view of a pair of adjacent panels constructed in accordance with a first embodiment of the invention and a supporting grid tee.

Various modifications of the panel assembly are contemplated. While the preferred arrangement is of the tegular type where the face of the panel assembly represented by the fabric 18 lies in a plane below the plane of the grid flanges 16, as shown in FIG. 2, a panel can be configured to have its face lie at or above the plane of the grid tee flanges. The edge detail, defined by the corner 48 can be greater or less in radius than that shown, can be beveled, and can even be square. Where desired, the gypsum board 20 or its equivalent can be omitted or can be cut out to mount an audio speaker. Similarly, the sound absorbing material 19 can be omitted to allow the speaker to be hidden behind the fabric and to operate without interference of such material. As suggested, the panel can be constructed to fit either 2'×2' or 2'×4' standard ceiling grid modules or can be made into other suitable polygonal shapes such as triangles, hexagons and octagons. The frame can be dyed, painted, stained or otherwise colored to match the color of the fabric. If desired, the sound absorbing board 19 can be replaced by drywall, foil-backed fiberglass, non-rigid fiberglass batts or like material.

Figure 4:
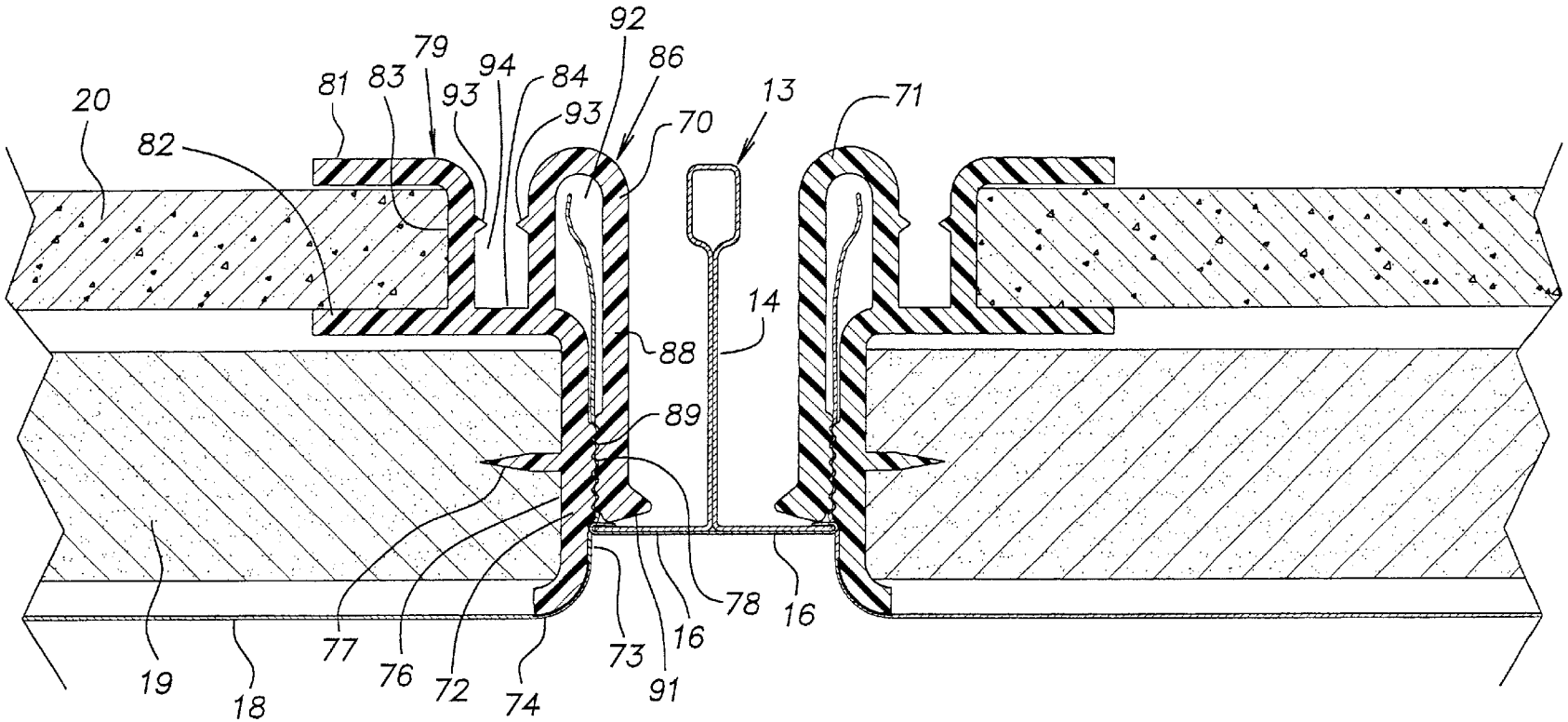
FIG. 4 is a fragmentary cross-sectional view of a pair of adjacent panels constructed in accordance with a second embodiment of the invention and a supporting grid tee.

FIG. 4 illustrates a second embodiment of a ceiling panel assembly 70. The panel assembly 70 includes a frame constructed of side members 71, sound absorbing material 19, sound transmission attenuating material 20 and a fabric face 18. In this embodiment, like numerals are used to identify like materials common with the embodiment of FIGS. 2 and 3. The frame side members 71 have identical cross-sections as shown in FIG. 4. The frame side member cross-section includes a generally vertical wall 72 that at its lower end is curved to transition from a vertical surface 73 to a horizontal surface 74. An inner face 76 of the wall includes a horizontally projecting barb 77. The outer vertical surface or face 73 has a series of gripping ribs 78 at its mid-section. A generally C-shaped panel 79 formed by flanges 81, 82 and a web 83 is joined to the vertical wall 72 by a web 84. An inverted J-shaped channel 86 extends upwardly from the web 84 horizontally, and then downwardly alongside an upper portion of the wall 72. An inside surface of a lower part 88 of the J-channel has ribs 89. At its lower end, the J-channel 86 has a horizontally extending flange 91 that engages the flange 16 of a supporting tee 13. An interior of the J-channel 86 forms a chamber 92.

Opposing areas of the J-channel 86 and the web 83 include ribs 93 to form the boundary of a rectangular open sided channel 94. Like the embodiment of FIGS. 2 and 3, a rectangular frame is constructed with appropriate lengths of the side members 71 having the cross-section illustrated in FIG. 4. The lengths are suitably mitered similar to the showing in FIG. 3. The frame is assembled around the rigid rectangular board of sound absorbing material 19 and a rectangular piece of drywall or other suitable sound transmission attenuating material 20. The projection or barb 77 digs into the sound absorbing material 19 to retain it in position. An angle bracket like the bracket 56 shown in FIG. 3 can be used in the open-faced channel 94 under the ribs 93 to lock the frame members 71 together.

With the frame members 71 assembled together around the sound absorbing material 19 and sound transmission attenuating material 20, the fabric 18 can be installed. This is accomplished in a manner like that described in connection with the embodiment of FIGS. 2 and 3. The margins of the fabric 18 are tucked between the wall 72 and leg or lower part 88 of the J-channel 86. The J-channel leg 88 resiliently grips the fabric material 18 with its ribs 89 holding it against the mutually gripping ribs 78 on the wall 72.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A prefabricated acoustical panel assembly for a suspended ceiling comprising a perimeter frame and a fabric sheet forming a visible face of the panel assembly, the frame comprising a plurality of extruded side members of substantially similar cross-section, the side members including integral gripping elements effective to solely retain margins of the fabric sheet in position on the frame, said extruded side members being mechanically joined to one another to form said perimeter frame.

2. A panel assembly according to claim 1, wherein the gripping elements are arranged to receive the margins of the fabric sheet from a direction from the face side of a panel such that the fabric is assembled on the frame into the gripping elements with the frame inverted.

3. A panel assembly as set forth in claim 1, wherein the cross-section of each side member includes a C-shaped channel, and an angle bracket is frictionally locked in adjacent ends of the side members in said C-shaped channels to join said members together.

4. A panel assembly as set forth in claim 1, wherein said side members have an identical cross-section and said cross-section includes a support surface for resting on a flange of a grid tee member.

5. A panel assembly as set forth in claim 4, wherein said support surface is spaced above the fabric face to form a tegular style panel.

6. A panel assembly as set forth in claim 1, further comprising a layer of sound transmission attenuating material, the cross-section of each of said members cooperating to form a receiving pocket for said layer of sound transmission attenuating material.

7. A panel assembly as set forth in claim 6, further comprising a layer of sound absorbing material disposed between said sound transmission attenuating material and said fabric sheet, wherein said pocket supports the weight of the sound transmission attenuating material and thereby isolates the weight of the same from the sound absorbing material.

8. A panel assembly as set forth in claim 1, wherein the cross-section includes a chamber for receiving the edges of the fabric sheet.

9. A panel assembly as set forth in claim 1, wherein the cross-section includes a rounded corner portion that is wrapped by a visible part of the fabric when the fabric is gripped by said gripping elements.

10. A panel assembly according to claim 1, said panel assembly further comprising a layer of sound absorbing material.

11. A panel assembly according to claim 10, said panel assembly further comprising a layer of sound transmission attenuating material.

12. A panel assembly according to claim 11, wherein said layer of sound absorbing material is disposed between said layer of sound transmission attenuating material and said fabric sheet.

13. A panel assembly as set forth in claim 10, wherein said sound absorbing material is rigid fiberglass board.

14. A panel assembly as set forth in claim 13, wherein said cross-section includes a retaining element for retaining said sound absorbing rigid fiberglass board in place.

15. A panel assembly as set forth in claim 11, wherein said sound transmission attenuating material is gypsum board.

16. A panel assembly as set forth in claim 1, wherein the gripping elements are disposed on opposed wall elements of said cross-sections.

17. A panel assembly according to claim 1, said cross-section having a lower flange capable of supporting a layer of sound absorbing material.

18. A panel assembly according to claim 1, said cross-section having a corner portion wrapped by a visible part of the fabric sheet, the corner portion having an extension extending towards the center of the panel, said extension having a lower surface which angles away from said fabric sheet.

* * * * *